US005713146A

United States Patent [19]

Reeves, Sr.

[11] Patent Number: 5,713,146

[45] Date of Patent: Feb. 3, 1998

[54] PICTURE FRAME DISPLAY WITH SLIDE IN MERCHANDISE PACKAGE AND GRAPHICS

[76] Inventor: James R. Reeves, Sr., 846 Moss Farms Rd., Cheshire, Conn. 06410

[21] Appl. No.: 668,768

[22] Filed: Jun. 24, 1996

[51] Int. Cl.[6] ..... G09F 7/02

[52] U.S. Cl. ..... 40/611; 40/649; 40/722; 40/765

[58] Field of Search ..... 40/611, 615, 649, 40/722, 734, 757, 765, 766, 800

[56] References Cited

U.S. PATENT DOCUMENTS

| | | | |
|---|---|---|---|
| 1,421,022 | 6/1922 | Mollet | 40/611 |
| 2,259,272 | 10/1941 | Sholkin et al. | 40/611 |
| 2,297,574 | 9/1942 | McCord | 40/611 |
| 2,469,369 | 5/1949 | Clark | 40/611 |
| 2,617,217 | 11/1952 | Behr | 40/649 |
| 3,771,245 | 11/1973 | Mabrey et al. | 40/615 X |
| 3,803,738 | 4/1974 | Weiss | 40/306 |
| 3,918,187 | 11/1975 | Vogele | 40/611 X |
| 4,041,630 | 8/1977 | Holbrook | 40/765 |
| 4,282,667 | 8/1981 | Glade | 40/16 |
| 5,046,273 | 9/1991 | Virvo | 40/611 X |
| 5,105,567 | 4/1992 | Real | 40/158.1 |
| 5,189,822 | 3/1993 | Schmanski et al. | 40/611 |
| 5,267,405 | 12/1993 | Seggerson | 40/611 X |
| 5,595,009 | 1/1997 | Rummer | 40/611 X |

FOREIGN PATENT DOCUMENTS

| | | | |
|---|---|---|---|
| 1004909 | 3/1957 | Germany | 40/615 |

*Primary Examiner*—Brian K. Green
*Assistant Examiner*—Andrea Chop
*Attorney, Agent, or Firm*—Ross, Ross & Flavin

[57] ABSTRACT

A unit for displaying merchandise in a picture frame look with advertising graphics as a background, the merchandise being encapsulated in a clear, thermoformed container housed by the frame, making the merchandise pilfer-proof and giving it a high gloss finish, the graphics background and the thermoformed container being easily changed by sliding them in and out of the frame, all while the display is mounted in the retail environment without requiring any additional tools, fixtures, or disassembly.

1 Claim, 3 Drawing Sheets

PICTURE FRAME DISPLAY WITH SLIDE IN MERCHANDISE PACKAGE AND GRAPHICS

BACKGROUND OF THE INVENTION

1. Field of the Invention

The invention relates to merchandise display units.

2. Description of the Prior Art

There are a wide variety of merchandise display units in the prior art.

However, to my knowledge, there are no units for displaying merchandise in a picture frame look with advertising graphics as a background, the merchandise being encapsulated in a clear, thermoformed container housed by the frame, making the merchandise pilfer-proof and giving it a high gloss finish, the graphics background and the thermoformed container being easily changed by sliding them in and out of the frame, all while the display is mounted in the retail environment without requiring any additional tools, fixtures, or disassembly.

SUMMARY OF THE INVENTION

The invention hereof provides a unit for displaying merchandise in a picture frame look with advertising graphics as a background, the merchandise being encapsulated in a clear, thermoformed container housed by the frame, making the merchandise pilfer-proof and giving it a high gloss finish, the graphics background and the thermoformed container being easily changed by sliding them in and out of the frame, all while the display is mounted in the retail environment without requiring any additional tools, fixtures, or disassembly.

DESCRIPTION OF THE PREFERRED EMBODIMENT

Figure 1:
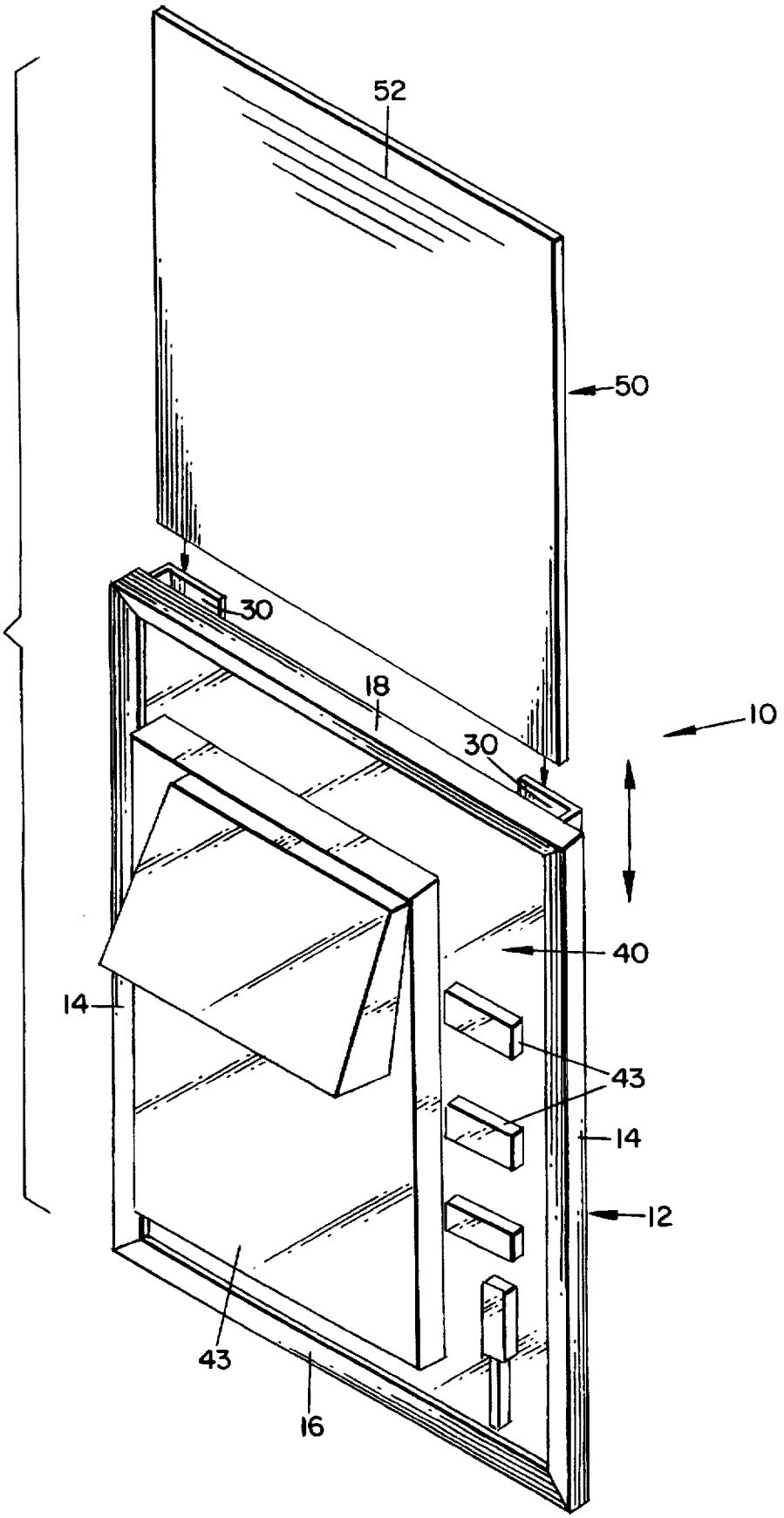
FIG. 1 is an exploded, perspective view of a picture frame display embodying the invention.

Referring to FIG. 1, a picture frame display 10 includes a rectangular frame 12, a clear, transparent, thermoformed merchandise package 40, and a graphics panel 50.

Frame 12 is fabricated from metal or plastic and includes a pair of spaced, upright side rails 14 interconnected at their lower ends by a horizontally-extending bottom rail 16 and interconnected at their upper ends by a horizontally-extending, removable top rail 18.

Spaced, horizontally-disposed cross braces 20 extend between and are fixed at their opposite ends to the rear faces of side rails 14 to provide stability to frame 12. Additional cross braces or diagonal braces, not shown, may be used as desired.

Spaced, rearwardly facing hangers 22 are fixed to the rear faces of one of the cross braces 20 as by bolts 24 and nuts 26 to facilitate hanging of frame 12 relative to any appropriate supporting surface.

Figure 2:
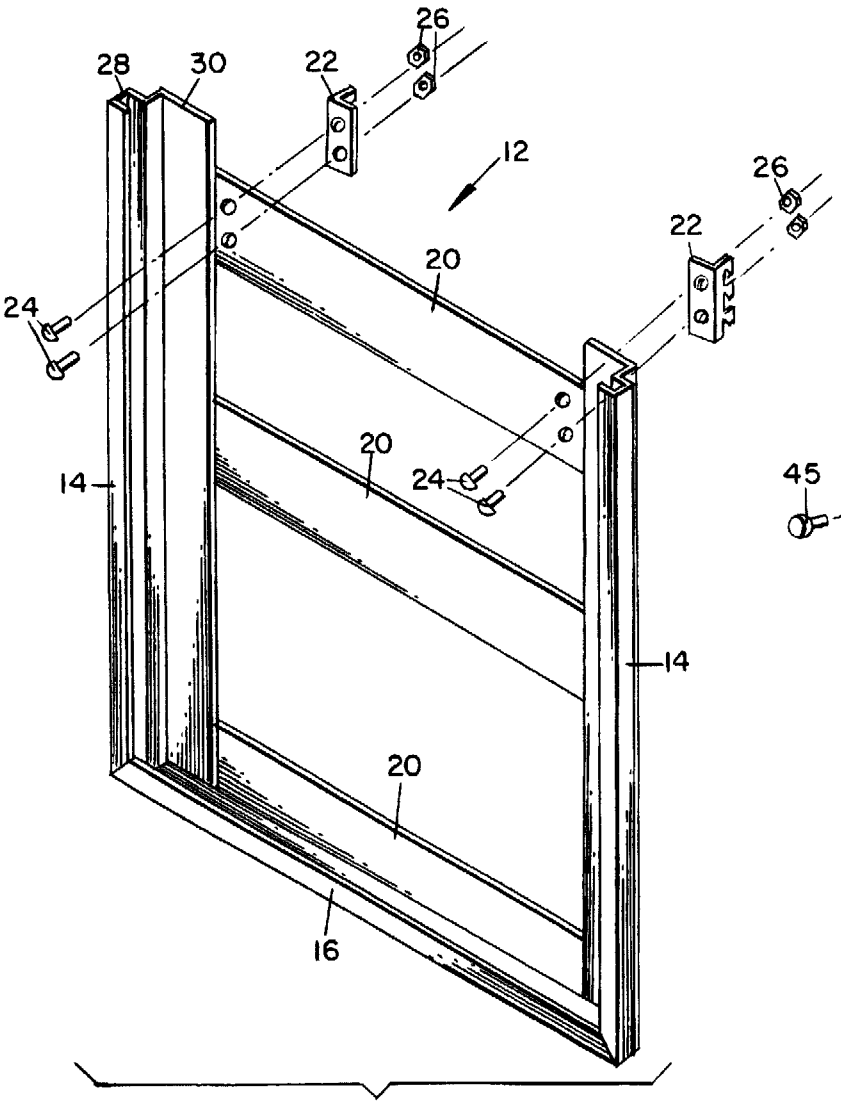
FIG. 2 is an exploded, perspective view of the frame element of the picture frame display of FIG. 1 with the top rail of the frame omitted.
Figure 4:
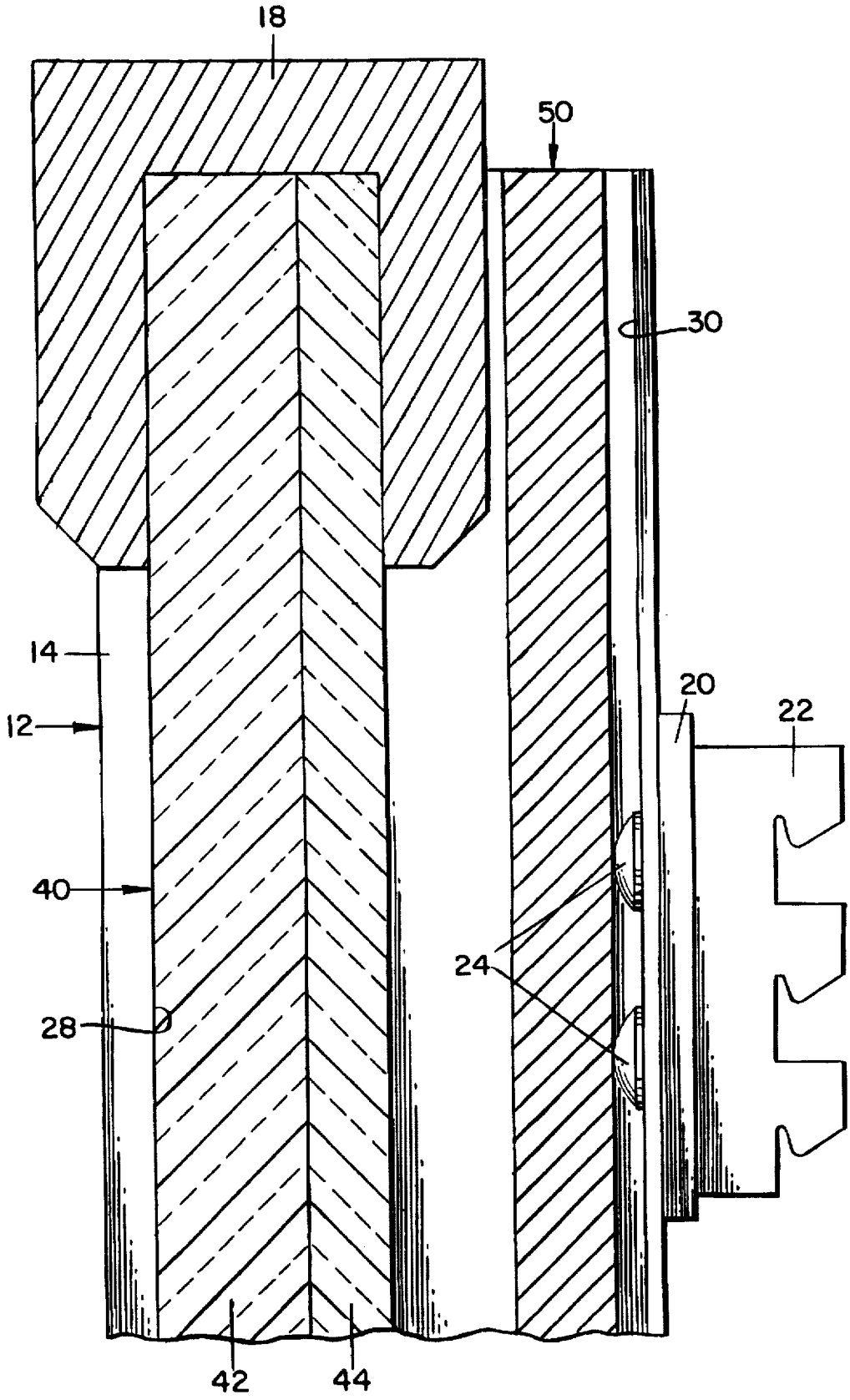
FIG. 4 is an enlarged, fragmentary, longitudinal cross sectional view of the picture frame display of FIG. 1.

As best seen in FIG. 2, each side rail 14 is shaped to define a pair of vertically-extending, integral, adjacent, front and rear channels 28 and 30, respectively.

The size and spacing of front channels 28 are appropriate to slidably receive merchandise package 40 therein, as will appear.

The size and spacing of rear channels 30 are appropriate to slidably receive graphics panel 50 therein, so as to be disposed rearwardly of merchandise package 40, as will appear.

Merchandise package 40 is fabricated from a clear, transparent plastic material which is thermoformed to encapsulate merchandise such as a tool kit and individual tools, not shown.

Figure 3:
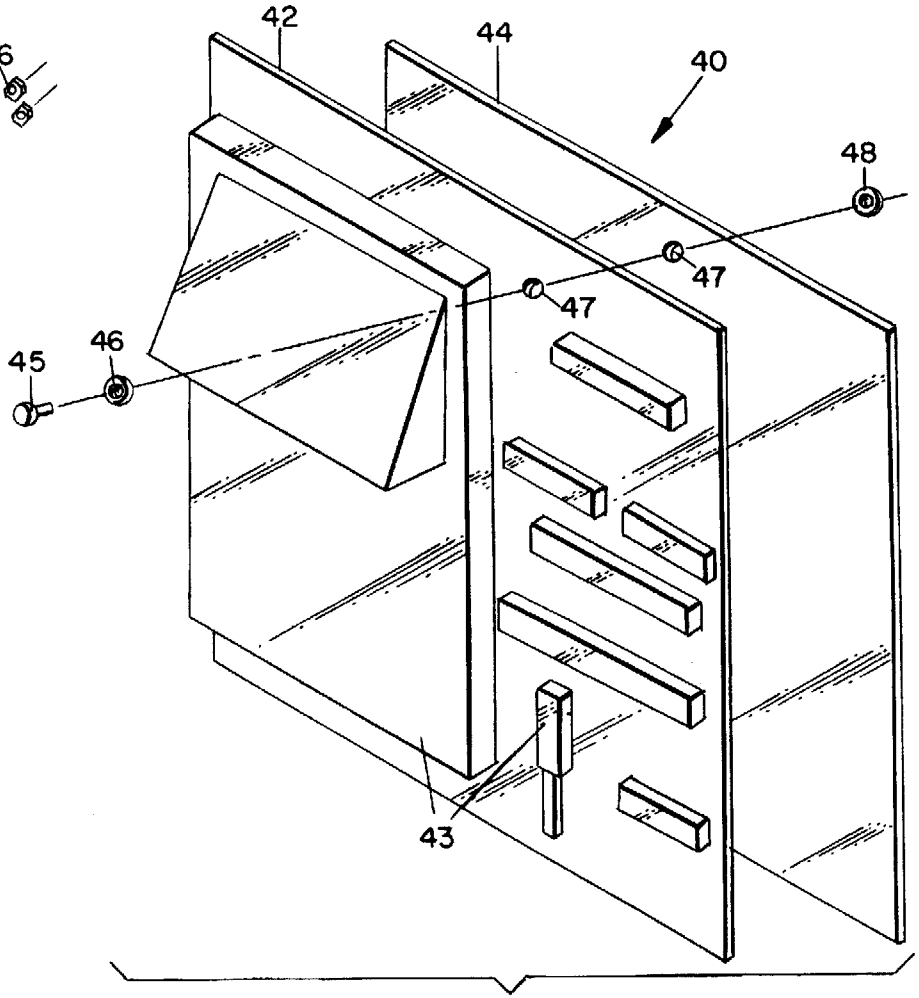
FIG. 3 is an exploded, perspective view of a merchandise package for use with the picture frame display of the invention.

As best seen in FIG. 3, merchandise package 40 includes a clear, transparent, rectangular, front panel 42 with appropriately sized pockets 43 thermoformed therein of sufficient number to accept the merchandise and a clear, transparent rectangular rear panel 44 to support the merchandise and to provide a high-gloss appearance.

Front panel 42 and rear panel 44 are brought into engagement to enclose the merchandise and are locked together as by male fasteners 45 which extend through fibre washers 46 and through aligned openings 47 in the panels and are engaged with female fasteners 48 on the rear face of rear panel 44.

While only one such male and female fastener combination is shown in FIG. 3, as many fasteners as desired may be employed to secure the panels together making the package pilfer-proof and insuring against removal of the merchandise therefrom.

Graphics panel 50 is of generally square or rectangular shape and carries advertising graphics 52 on its face appropriate to the product contained in merchandise package 40.

To use picture frame display 10 for display purposes, top rail 18 is removed to provide access to the open upper ends of front channels 28 of side rails 14 of frame 12.

Merchandise package 40 is slidably inserted into front channels 28 of side rails 14 of frame 12 and top rail 18 is replaced on the upper ends of side rails 14 to close the front channels and to prevent removal of the merchandise package.

Appropriate locking means, not shown, may be employed to prevent unwanted removal of top rail 18 and merchandise package 40.

Graphics panel 50 is then slidably inserted into the open upper ends of rear channels 30 of side rails 14 of frame 12 so as to be disposed rearwardly of merchandise package 40.

Since merchandise package 40 is transparent, advertising graphics 52 on graphics panel 50 relating to the product are clearly visible through the merchandise package.

Picture frame display 10 may then be suspended by hangers 22 from a wall or other supporting surface, not shown.

Merchandise package 40 and graphics panel 50 may quickly and easily be removed from picture frame display 10 and replaced, as desired.

I claim:

1. A unit for displaying merchandise such as a tool kit and individual tools in a picture frame look with advertising graphics as a background comprising, a frame, a clear, transparent, thermoformed package containing the merchandise to be displayed and a panel containing advertising graphics pertaining to the merchandise to be displayed, the frame having a pair of spaced, upright side rails interconnected at their lower ends by a horizontally-extending bottom rail and interconnected at their upper ends by a horizontally-extending, removable top rail, each side rail being shaped to define a pair of vertically-extending, integral, adjacent, front and rear channels, the size and spacing of the front channels being appropriate to slidably receive therein the package containing the merchandise when the top rail is removed, the size and spacing of the rear channels being appropriate to slidably receive therein the graphics panel so as to be disposed rearwardly of the package, with the advertising graphics thereon being clearly visible through the package, the package being secured against removal from the frame upon replacement of the top rail, hangers on the frame for suspending the unit from a supporting surface, cross braces extending between and fixed at their opposite ends to the side rails of the frame for providing stability to the frame, and the package being fabricated from a clear, transparent plastic material which is thermoformed to encapsulate the merchandise, the package including a clear, transparent, rectangular, front panel with appropriately sized pockets thermoformed therein of sufficient number for accepting the merchandise and a clear, transparent rectangular rear panel for supporting the merchandise and providing a high-gloss appearance, the front panel and rear panel being brought into engagement to enclose the merchandise and being locked together by fasteners.

* * * * *